US006386299B1

(12) United States Patent
Kato

(10) Patent No.: US 6,386,299 B1
(45) Date of Patent: May 14, 2002

(54) METHOD AND APPARATUS FOR REAMING PILOT HOLE

(75) Inventor: Shohei Kato, Tokyo (JP)

(73) Assignee: Japan Drilling Co., Ltd., Tokyo (JP)

( * ) Notice: Subject to any disclaimer, the term of this patent is extended or adjusted under 35 U.S.C. 154(b) by 0 days.

(21) Appl. No.: 09/634,836

(22) Filed: Aug. 8, 2000

(30) Foreign Application Priority Data

Apr. 19, 2000 (JP) ..... 2000-117350

(51) Int. Cl.[7] ..... E21B 10/10
(52) U.S. Cl. ..... 175/62; 175/385
(58) Field of Search ..... 175/62, 93, 385, 175/353, 408, 323, 325, 2

(56) References Cited

U.S. PATENT DOCUMENTS 4,319,648 A * 3/1982 Cherrington ..... 175/53
4,828,050 A * 5/1989 Hashimoto ..... 175/45
5,325,932 A * 7/1994 Anderson et al. ..... 175/325.3
5,485,888 A * 1/1996 England ..... 175/53
5,687,805 A * 11/1997 Perry ..... 175/53
5,979,574 A * 11/1999 Osadchuk ..... 175/353

* cited by examiner

*Primary Examiner*—Frank S. Tsay
(74) *Attorney, Agent, or Firm*—Oliff & Berridge, PLC

(57) ABSTRACT

By using a reaming machine which arranges a plurality of hydraulic hammer driven drill bits in parallel on a cross section to be reamed, a horizontal or gently inclined pilot hole is reamed. A pressurized water introducing drill pipe and a drill pipe as a discharge pipe are connected to the reaming machine, a seal which forms a sealing between the drill bits and a reamed hole is provided, and a passage for feeding drilling water into the drill pipe is provided, whereby the reaming machine can be propelled while discharging cuttings with a small amount of water through the drill pipe.

5 Claims, 6 Drawing Sheets

1

METHOD AND APPARATUS FOR REAMING PILOT HOLE

BACKGROUND OF THE INVENTION

1. Field of the Invention

The present invention relates to a method and apparatus for reaming or enlarging a horizontal or gently inclined pilot hole. Here, the pilot hole is a drilled hole extending in a straight line or in a curved line and having a bore diameter of approximately 100–300 mm which is drilled in the earth.

2. Description of the Prior Art

A drilling machine which arranges a plurality of hydraulic-hammer driven drill bits relative to a drilling cross section has been marketed. The drilling machine is suitable for drilling a hole having a bore diameter of approximately 250 mm–1000 mm. In this drilling machine, a plurality of drill bits which are arranged on a drilling surface are respectively driven by hydraulic hammers and the whole drilling machine is slowly rotated by means of a drill pipe so as to perform drilling. The drilling machine, for example, does not require a large torque for rotating the whole drilling system compared to a rotary drilling machine which performs drilling by rotating the drilling machine per se so that the drilling machine may be made compact while assuring the powerful drilling performance. That is, the rotational force sufficient to shift the contact surface of the drill bits is transmitted by means of the drill pipe and it is unnecessary to produce the rotational torque contributed to drilling. Since the drilling is performed by driving the compact and powerful hydraulic hammers which perform the impact drilling, the drilling machine exhibits the high performance. Although the drilling machine can perform the highly efficient drilling with the use of compact drill bits and a small amount of pressurized liquid, the diameter of the drilled hole is large so that there exists a drawback that a large amount of water and/or highly viscous drilling fluid becomes necessary to discharge cuttings(drilled rock powder). Accordingly, conventionally, it has been a common knowledge that such drilling machine may not be applicable to the reaming of horizontal or gently inclined pilot holes. Here, a gently inclined hole means a hole having an inclination angle of 30° or below.

SUMMARY OF THE INVENTION

It is an object of the present invention to overrule such a conventional knowledge and to provide a method and apparatus which use the drilling machine provided with a plurality of hydraulic hammer driven bits as a reaming machine for reaming a horizontal or gently inclined pilot hole at high efficiency.

It is another object of the present invention to get a larger diameter reamed hole in one process using very less amount of water assumption to discharge cuttings.

The present invention has been made to solve the above-mentioned problems and provides a method for reaming a pilot hole characterized in that, in reaming a horizontal or gently inclined pilot hole, a reaming machine which arranges a plurality of hydraulic hammer driven drill bits in parallel on a reaming cross section is used, and a drill pipe is connected to a trailing-end side or/and a leading-end side of the reaming machine, and the reaming is performed while discharging cuttings through the pilot hole or/and the drill pipe. In view of the difficulty of discharging cuttings through a reamed hole of a large diameter, the reaming apparatus of this type has not been considered to be suitable for reaming the horizontal or the gently inclined pilot hole. However, the present invention has overruled such a conventional common knowledge and has made it possible to ream the horizontal or gently inclined pilot hole. The most outstanding feature of the present invention lies in adopting following methods (a)–(d) for discharging cuttings.

(a) Cuttings is discharged through the pilot hole.

(b) Cuttings is discharged through the drill pipe mounted on the leading-end side of the reaming machine.

(c) Cuttings is discharged through the pilot hole and the drill pipe mounted on the leading-end side of the reaming machine.

(d) Cuttings is discharged through the drill pipe mounted on the trailing-end side of the reaming machine.

The present invention is characterized by the realization of the transportation and the discharge of cuttings with a little amount of water by adopting any one of the above-mentioned means which can increase the flowing speed of cuttings by making the cuttings pass through a discharge passage of a narrow cross section.

The apparatus which can suitably carry out the above-mentioned method according to the present invention is an apparatus for reaming a pilot hole which is characterized by including a reaming machine which arranges a plurality of hydraulic hammer driven drill bits in parallel and drill pipes which are connected to front and rear portions of the reaming machine and further including a seal which is mounted on an outer periphery of the reaming machine for sealing a portion of the reaming machine extending between a drill-bit side front face and a rear side of the reaming machine. When this apparatus is of the type in which the rear-end side drill pipe of the reaming machine propels the reaming machine, the apparatus is an apparatus for reaming a pilot hole which is provided with the drill pipe for pushing the reaming machine from the rear side and simultaneously supplying pressurized water at a trailing-end side of the reaming machine and the pilot hole or/and the front-end side drill pipe is used as cuttings discharge passage.

On the other hand, when the apparatus is of the type in which the front-end side drill pipe of the reaming machine tows the reaming machine, the apparatus is preferably an apparatus for reaming a pilot hole which is provided with the drill pipe for towing the reaming machine in the frontward direction and simultaneously supplying pressurized water at the front end side of the reaming machine, connects the drill pipe or other pipe to the trailing-end side of the reaming machine and uses the trailing-end side drill pipe or/and other pipe as cuttings discharge passage. Here, the trailing-end side pipe is not required to transmit pressure and torque and hence, such a pipe is not limited to the drill pipe.

Further, the apparatus may be an apparatus for reaming a pilot hole in which the apparatus is provided with the drill pipe which tows the reaming machine in the frontward direction and simultaneously supplies pressurized water at the leading-end side of the reaming machine and uses the pilot hole as cuttings discharge passage without connecting the drill pipe or other pipe to the trailing-end side of the reaming machine.

DETAILED DESCRIPTION OF THE PREFERRED EMBODIMENTS

Figure 1:
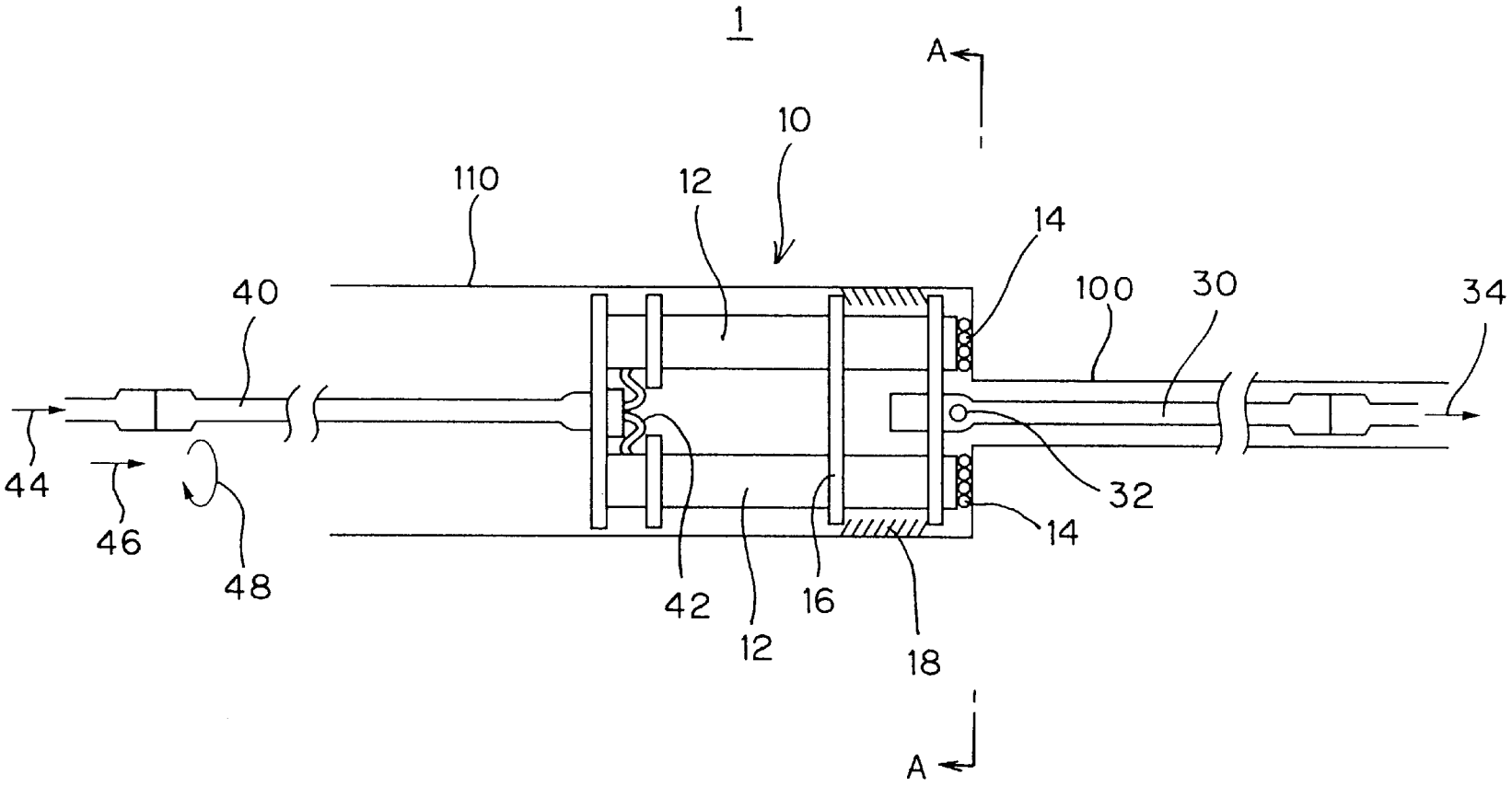
FIG. 1 is a side view of a pilot hole reaming apparatus according to the first embodiment of the present invention.

Embodiments of the present invention are explained hereinafter in conjunction with attached drawings. FIG. 1 is a side view of a pilot hole reaming apparatus 1 according to the first embodiment of the present invention and FIG. 2 is a cross-sectional view taken along a line A—A of FIG. 1 and seen in an arrow direction.

As shown in FIG. 1, the reaming apparatus 1 is of the type which is provided with a leading-end side drill pipe 30 and a trailing-end side drill pipe 40 at front and rear end portions of a reaming machine 10. In FIG. 1, a pilot hole 100 is reamed or enlarged by the reaming machine 10 and is formed into a reamed hole 110. In the inside of the pilot hole 100, the leading-end side drill pipe 30 which discharges cuttings to the outside of a hole is disposed. In the embodiment shown in FIG. 1, the reaming machine 10 is pushed in the direction of an arrow 46 by means of the trailing-end side drill pipe 40 and pressurized-water is supplied through the trailing-end side drill pipe 40 in the direction of an arrow 44. Then, this pressurized water is supplied to a plurality of hydraulic hammers 12 through pressurized water tubes 42. The pressurized water ejected from the hydraulic hammers 12 is blown off from the drill bits 14 and then is discharged together with the cut powder in any one of discharge passages consisting of a discharge passage through the inside of the pilot hole 100, a discharge passage through the leading-end side drill pipe 30 disposed in the inside of the pilot hole 100, and a discharge passage through both the pilot hole 100 and the drill pipe 30. FIG. 1 shows the discharge passage where the pressurized water is discharged together with the cuttings through the drill pipe 30 in the direction of an arrow 34.

A seal 18 is mounted on an outer periphery of the reaming machine 10 so as to seal the rear side of the reaming machine 10 from a reaming working face which the drill bits 14 drill. Accordingly, water blown off from the drill bits 14 is prevented from flowing back toward the rear side of the reaming machine 10 and is fed into the inside of the pilot hole 100 or/and the inside of the drill pipe 30. Here, suction devices may be provided to the distal end portions of the pilot hole 100 or/and the drill pipe 30 disposed outside the hole. A bentonite or the like may be added to the pressurized water. However, it is unnecessary to produce the pressurized water of high viscosity.

Figure 2:
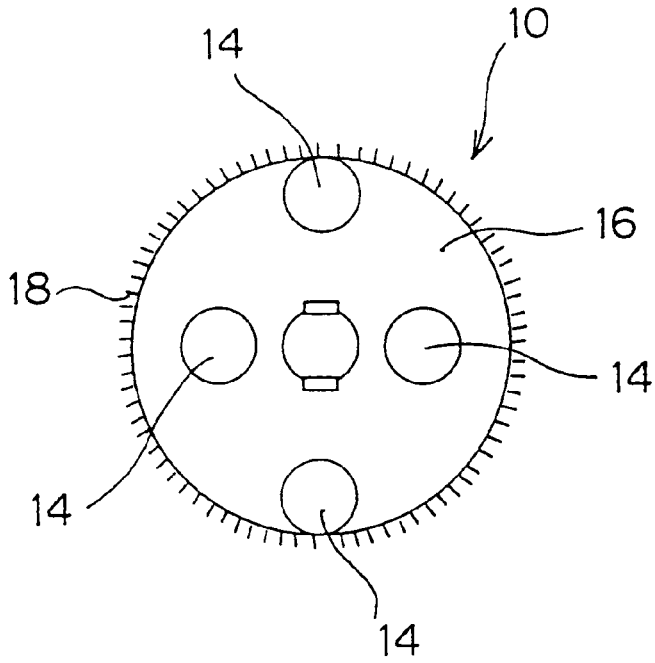
FIG. 2 is a cross-sectional view taken along a line A—A of FIG. 1 and seen in an arrow direction.

As shown in FIG. 2, the reaming machine 10 is provided with a plurality of drill bits 14 which are operated on an drilling plane. A plurality of drill bits 14 are respectively directly connected with hydraulic hammers 12. The hydraulic hammers 12 respectively powerfully drive the drill bits 14 to make them independently act on the drilling plane. By gently rotating a frame 16 in the rotational direction of an arrow 48, the contact surfaces of the drill bits 14 are moved in sequence within the drilling plane in a concentric manner thus drilling the whole drilling plane. The rotation of the frame 16 shown by the arrow 48 indicative of the rotational direction is irrelevant to the drilling force and merely is used for gradually changing the positions where the drill bits 14 come into contact with the drilling plane and hence, a large torque is unnecessary.

Figure 3:
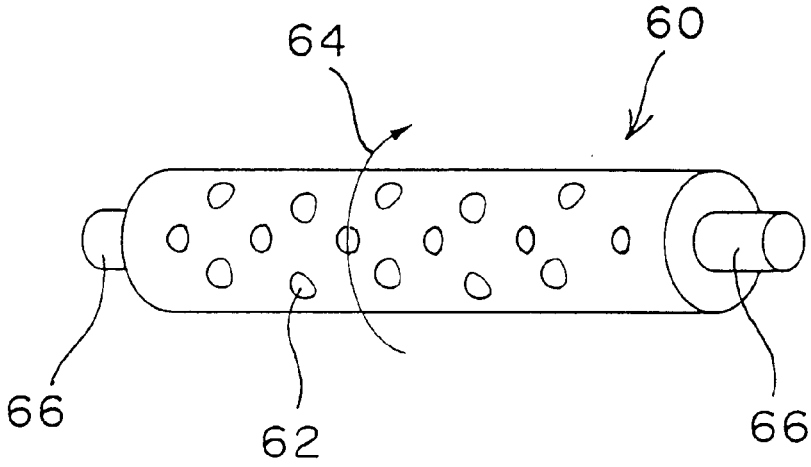
FIG. 3 is a perspective view of a roller reamer.

FIG. 3 is a perspective view showing a roller reamer 60 mounted on the periphery of the reaming machine 10. By mounting the roller reamer 60 shown in FIG. 3 on the outer periphery of the frame 16 of the reaming machine 10, the wall surface of the reamed hole may have a smooth finishing and a torque owing to a friction between the reaming machine and the wall surface of the hole may be decreased. The roller reamer 60 is provided with a large number of cutters 62 on the peripheral surface of a cylinder and is rotated in the rotational direction of an arrow 64 while being supported on a shaft 66. Further, a labyrinth type seal member 18 made of a resilient material such as a wire brush or rubber is mounted on the outer periphery of the frame 16. This seal member 18 acts such that the seal member 18 prevents the drilling water or the cuttings from flowing into the back side of the reaming machine 10 from the outer periphery of the reaming machine 10 and supplies the drilling water or the cuttings into the inside of the pilot hole 100 or/and the inside of the drill pipe 30. Since the pilot hole 100 or/and the drill pipe 30 have small cross sections, the flowing speed of the pressurized water is high so that the cuttings is efficiently transported even with a small amount of the pressurized water. By mounting suction devices such as air lifts, ejectors, suction pumps or the like on discharge ends of the pilot hole 100 or/and the drill pipe 30, the transporting efficiency of the cuttings is further enhanced.

A drill pipe 40 which supplies the pressurized water into the hydraulic hammers 12 and simultaneously propels the reaming machine 10 is arranged at the trailing-end side of the reaming machine 10. This drill pipe 40 is pushed in the direction of the arrow 46 by a pusher not shown in the drawing which is mounted on a ground outside the hole so as to push and propel the reaming machine 10.

Figure 4:
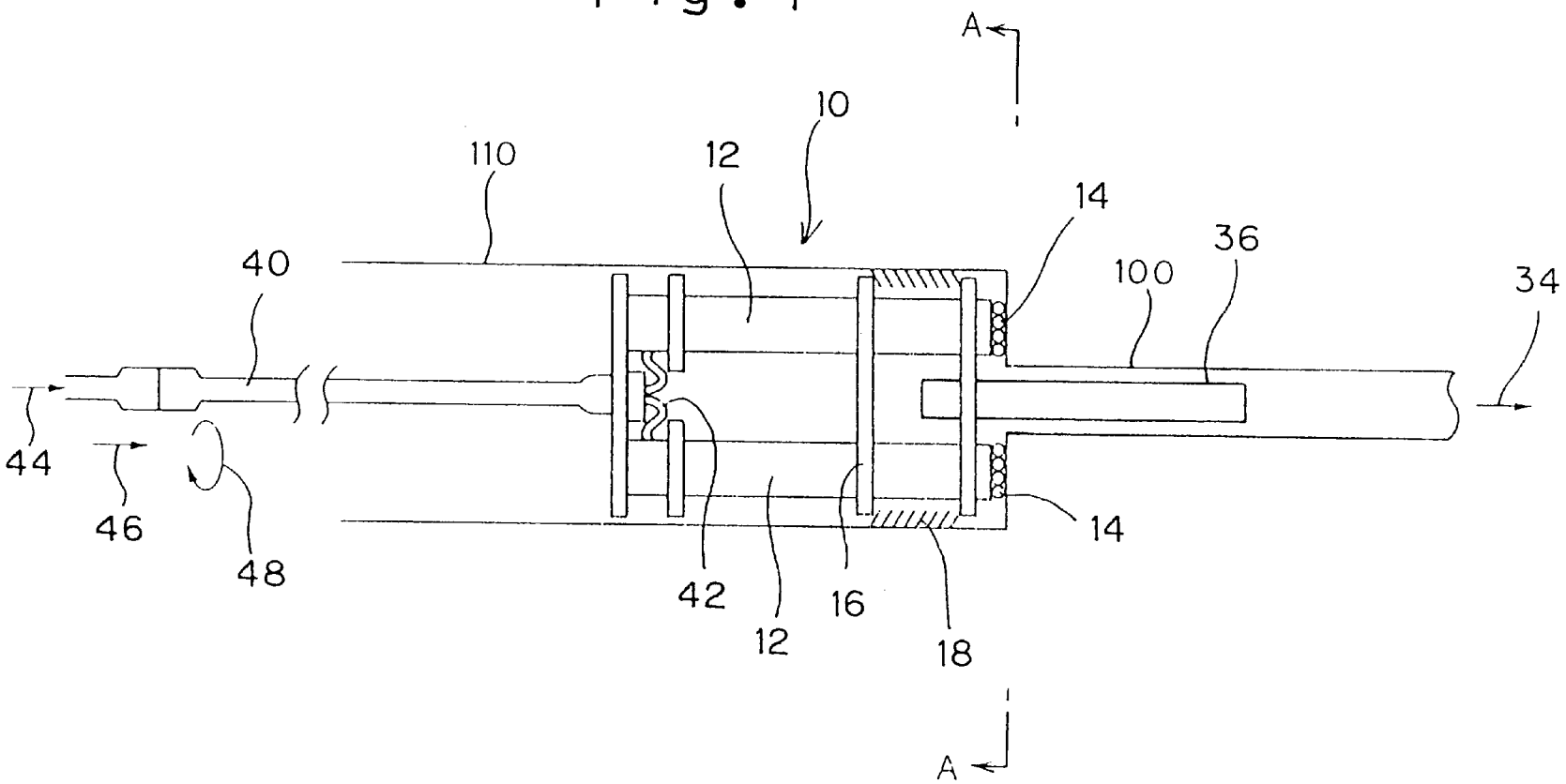
FIG. 4 is a side view of a pilot hole reaming apparatus according to the second embodiment of the present invention.

FIG. 4 is a side view showing a reaming apparatus 1 of the second embodiment. This embodiment is provided with a guide 36 which guides the reaming machine 10 in the inside of the pilot hole 100, while the embodiment is not provided with the leading-end side drill pipe 30. The cuttings is discharged through the pilot hole 100. The structure and the manner of operation of the reaming machine 10 and the trailing-end side drill pipe 40 are same as those shown in FIG. 1.

Figure 5:
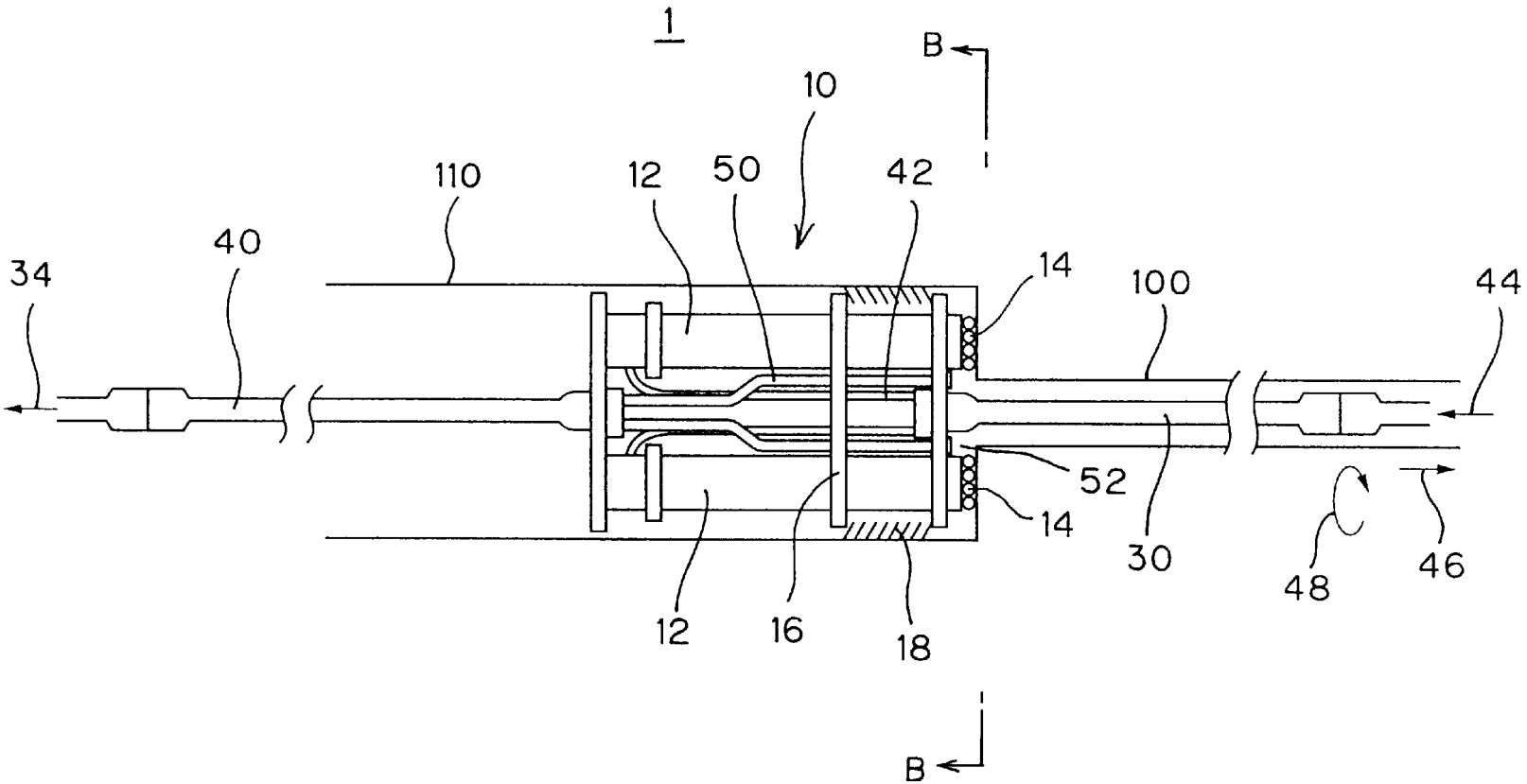
FIG. 5 is a side view of a pilot hole reaming apparatus according to the third embodiment of the present invention.
Figure 6:
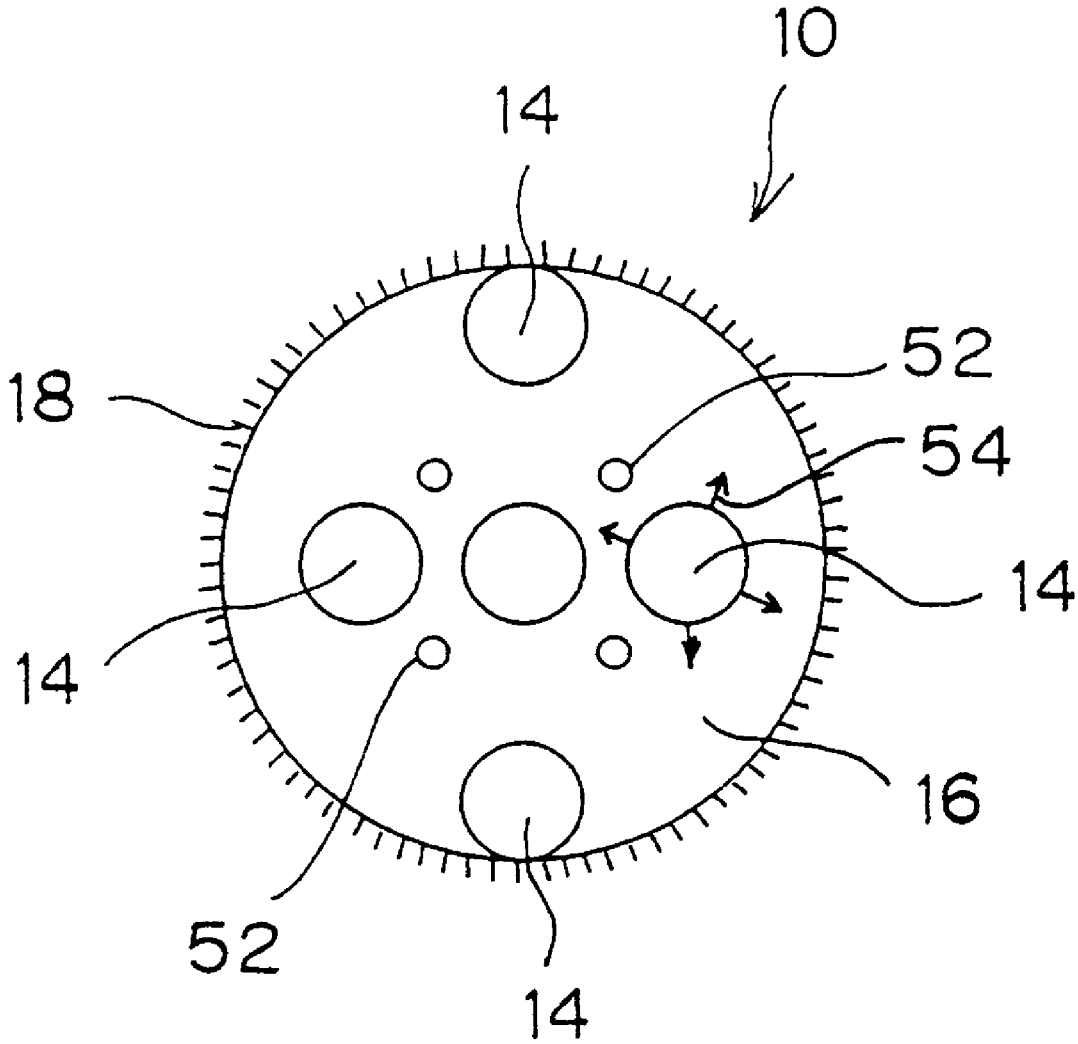
FIG. 6 is a cross-sectional view taken along a line B—B of FIG. 5 and seen in an arrow direction.

FIG. 5 shows a reaming apparatus 1 of the third embodiment, wherein the reaming apparatus 1 of the type which tows the reaming machine 10 toward the pilot hole side (the leading-end side of the reaming machine). That is, when reaming machine 10 is towed in the propelling direction of the arrow 46, the drill pipe 30 is rotated in the rotational direction of the arrow 48 and the pressurized water is supplied in the pressurized water supply direction 44. The supplied water is supplied to the hydraulic hammers 12 through a pressurized water pipe 42. Water blown off from the drill bits 14 is sucked in the direction along the discharge water discharging direction 34 through discharge pipes 50. FIG. 6 is a cross-sectional view taken along a line B—B of FIG. 5 and seen in an arrow direction. Water 54 blown off from the drill bits 14 is made to flow into the water discharge tube 50 through the opening 52 together with the cuttings and is discharged through the water discharge pipe 50. Here, the leakage of water to the trailing-end side of the reaming machine 10 is prevented by mean of the seal 18. The reaming apparatus of this embodiment has the same constitution as the reaming apparatus shown in FIG. 1 with respect to other parts. The seal 18 is provided for feeding water blown off from the drill bits to the water discharge pipe 50 without causing the leakage of water. This water is made to flow in the inside of small-diameter pipes at a relatively high flowing speed together with the cuttings thus realizing the efficient transportation and discharge of the cuttings.

Figure 7:
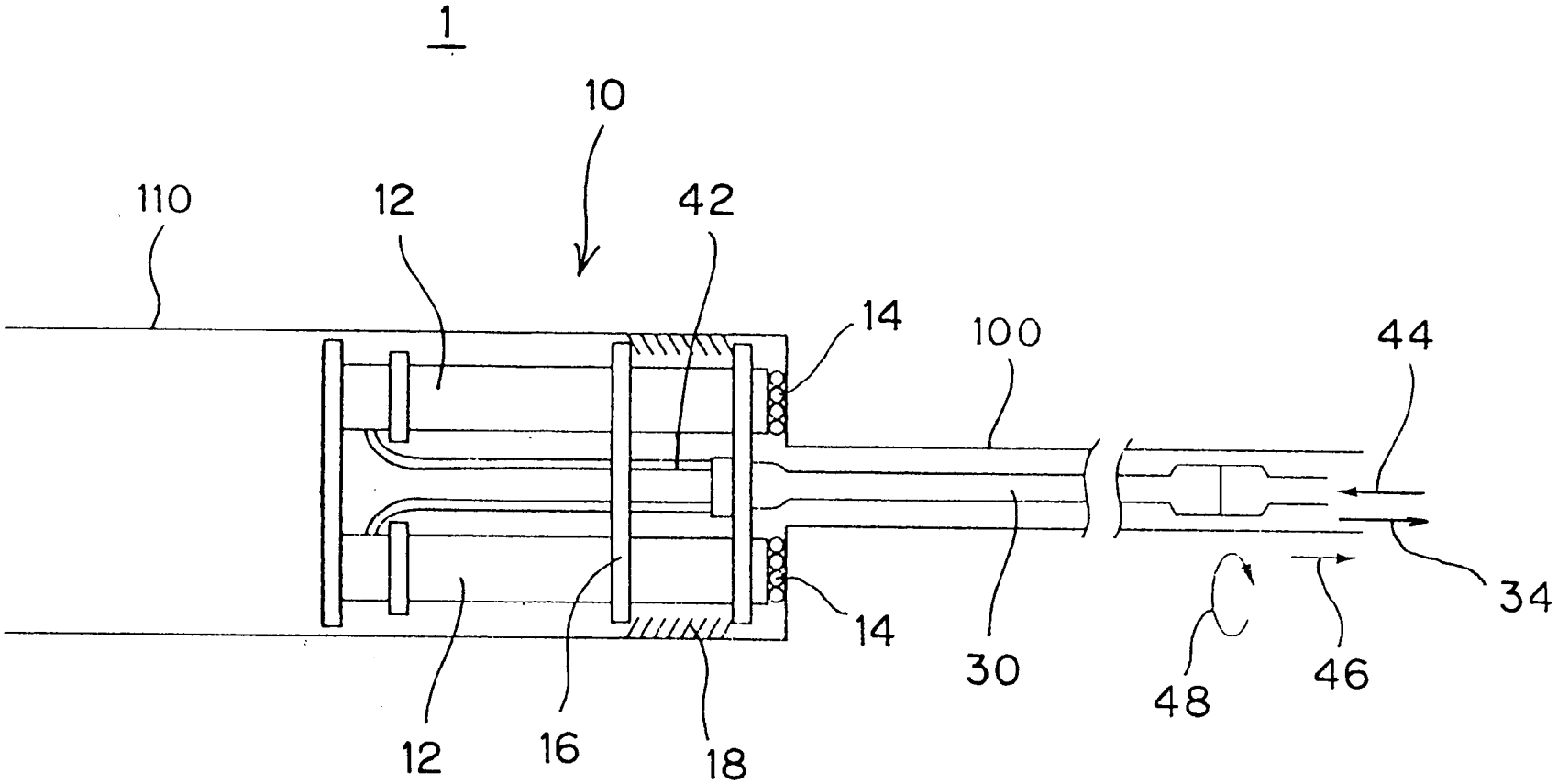
FIG. 7 is a side view of a pilot hole reaming apparatus according to the fourth embodiment of the present invention.

FIG. 7 shows a reaming apparatus 1 of the type which tows the reaming machine 10 toward the pilot hole side (leading-end side of the reaming machine) in the same manner as the embodiment shown in FIG. 5. In this embodiment, however, the reaming apparatus 1 is not provided with the trailing-end side drill pipe and water which mixes cuttings therein is discharged through the inside of the pilot hole disposed at the outside of the leading-end side drill hole. Along with towing of the reaming machine 10 in the propelling direction of the arrow 46, the drill pipe 30 is rotated in the rotational direction indicated by the arrow 48 and the pressurized water is supplied in the pressurized water supply direction indicated by the arrow 44. The supplied pressurized water is supplied to the hydraulic hammers 12 through the pressurized water pipes 42. Water blown off from the drill bits 14 is made to pass through the pilot hole 100 and is sucked in the water discharge direction 34.

Although the application of the reaming machine to the horizontal or gently inclined pilot hole has been considered impossible conventionally, according to the present invention, it becomes possible to efficiently use the reaming machine in reaming horizontal holes. Further, the use of muddy water of high density becomes unnecessary and hence, the economy is remarkably enhanced. Still further, the present invention provide the reaming method which can obtain the favorable finishing of the inner skin of the reamed hole.

Although the present invention has been explained heretofore in accordance with several embodiments, the present invention is not limited to these embodiments. Any modifications within the requisites of claims or equivalents of the requisites are included in the scope of claims.

What is claimed is:

1. A pilot hole reaming method for reaming a horizontal or gently inclined pilot hole, comprising:

employing a reaming machine having a plurality of hydraulic hammer driven drill bits in parallel on a cross section to be reamed;

connecting drill pipes to at least one of a trailing-end side and a leading-end side of the reaming machine; and discharging cuttings through at least one of the pilot hole and the drill pipe while reaming.

2. A pilot hole reaming apparatus, comprising:

a reaming machine having a plurality of hydraulic hammer driven drill bits in parallel;

drill pipes connected to at least one of a trailing-end side and a leading-end side of the reaming machine; and a seal mounted on an outer periphery of the reaming machine to form a seal between a drill-bit side front surface and a rearward side of the reaming machine.

3. A pilot hole reaming apparatus according to claim 2, wherein the drill pipe, which pushes the reaming machine from the rearward side and supplies pressurized water, is connected to the trailing-end of the reaming machine; and at least one of the pilot hole and the leading-end side drill pipe is used as a cuttings discharge passage.

4. A pilot hole reaming apparatus according to claim 2, wherein the drill pipe, which tows the reaming machine toward the frontward side and supplies pressurized water, is connected to the leading-end side of the reaming machine, and wherein a pipe, connected to the trailing-end side of the reaming machine and the trailing-end side pipe, is used as a cuttings discharge passage.

5. A pilot hole reaming apparatus according to claim 2, wherein the drill pipe, which tows the reaming machine toward the frontward side and supplies pressurized water, is connected to the leading-end side of the reaming machine and the pilot hole is used as a cuttings discharge passage.

* * * * *